US005400539A

United States Patent [19]

Moore

[11] Patent Number: 5,400,539

[45] Date of Patent: Mar. 28, 1995

[54] SELECTIVELY ADJUSTABLE FIREARM SCOPE MOUNT

[75] Inventor: Warren Moore, Kansas City, Mo.

[73] Assignee: Bulb Bopper, Inc., Kansas City, Mo.; a part interest

[21] Appl. No.: 176,774

[22] Filed: Jan. 3, 1994

Related U.S. Application Data

[62] Division of Ser. No. 879,946, May 8, 1992, Pat. No. 5,274,941.

[51] Int. Cl.[6] ..... F41G 1/387

[52] U.S. Cl. ..... 42/101; 33/247; 33/250; 33/260

[58] Field of Search ..... 42/101, 100; 33/245, 33/247, 248, 249, 250, 252, 254, 260

[56] References Cited

U.S. PATENT DOCUMENTS

| | | | |
|---|---|---|---|
| 691,248 | 1/1902 | De Zeng, Jr. | 33/248 |
| 2,237,395 | 4/1941 | Sweet | 42/101 |
| 2,743,525 | 5/1956 | Leupold | 33/248 |
| 2,783,539 | 3/1957 | Dahlberg | 33/248 |
| 2,830,373 | 4/1958 | Dahlberg | 33/248 |
| 2,951,292 | 9/1960 | Buehler | 33/248 |
| 3,187,435 | 6/1965 | Miller, Jr. | 33/248 |
| 3,471,932 | 10/1969 | Luning | 42/101 |
| 3,662,469 | 5/1972 | Chanon | 42/100 |
| 4,317,304 | 3/1982 | Bass | 33/247 |

FOREIGN PATENT DOCUMENTS

| | | | |
|---|---|---|---|
| 509491 | 3/1952 | Belgium | 33/246 |
| 116152 | 4/1946 | Sweden | 33/252 |
| 327769 | 3/1958 | Switzerland | 42/100 |
| 668831 | 1/1989 | Switzerland | 42/100 |
| 930125 | 7/1963 | United Kingdom | 33/248 |

OTHER PUBLICATIONS

Brownells Catalog No. 44 for 1991–1992, pp. 193, 194, 204, 206 and 207.

*Primary Examiner*—Stephen M. Johnson

*Attorney, Agent, or Firm*—Hovey, Williams, Timmons & Collins

[57] ABSTRACT

A selectively adjustable firearm scope mount is provided which includes a base for mounting to a firearm and a rib for receiving a scope assembly. The rib is preferably selectively positionable relative to the base as determined by a selected one of a plurality of individually and independently adjustable stops. The stops correspond to and are adjusted according to different ranges or cartridge loads and thus the selected relative position between the rib and the base. The stops are preferably carried by a rotatable turret presenting indicia corresponding to the various stops, each stop being positioned within a cavity. The turret may be fixed against undesired rotation by a catch. A pin is removable and replaceable without the need for tools thereby permitting ready substitution a new rib with scope assembly mounted thereto as a modular unit.

4 Claims, 1 Drawing Sheet

SELECTIVELY ADJUSTABLE FIREARM SCOPE MOUNT

This application is a divisional of application Ser. No. 07/879,946, now U.S. Pat. No. 5,274,941 filed May 8, 1992.

BACKGROUND OF THE INVENTION

1. Field of the Invention

This invention concerns a mount for a telescopic sight on a firearm which permits the shooter to preselect different range settings which can be quickly and easily changed without the need for tools or resighting. The scope mount hereof is also modular and permits the substitution of different telescopic sights on a firearm without the need to reset or adjust the preselected range settings.

2. Description of the Prior Art

Both in target shooting and hunting, the use of both iron sights and telescopic sights (hereinafter "scopes") is well known. Iron sights provide no magnification and require that the shooter align the target with the front and rear sights according to the particular sight provided. Scopes, on the other hand, include optics which typically present a magnified image and which also include a reticle such as a dot or cross hairs which the shooter optically places on the image of the target and then fires his shot. Such scopes typically include predetermined fractional degree click adjustments for windage and elevation, and are mounted to the handgun, rifle or shotgun by a base and rings.

The trend in competition shooting, as well as in many types of hunting, is to use scopes instead of iron sights because shooters using scopes can usually shoot more accurately. However, the use of the elevation adjustment on the scope is usually strictly a guess, and the elevation cannot be preset for different ranges, cartridge loads, or for the angle of the shot if other than level. When accuracy is paramount, the scope is adjusted for elevation or windage as determined by bench shooting at a predetermined range or by bore sighting. Once the scope and firearm are "sighted in", the shooter is obviously reluctant to further adjust the elevation setting. In the alternative, the shooter must mentally compensate for each new distance or load by "sighting in" with the cross-hours above or below the image at the target.

There has thus developed a need for a scope mounting which can be preset for several different ranges or loads, which can be used with handguns or long firearms, and which can readily receive a conventional scope and its rings thereon.

SUMMARY OF THE INVENTION

These needs are met by the selectively adjustable firearm scope mount of the present invention. The scope mount hereof allows the shooter to establish, using individually adjustable stops, a plurality of scope settings according to different ranges, loads, elevation angles or the like. The shooter may then simply choose the position of the scope corresponding to a desired range, etc., and be "on target" for that range. The shooter may change the position of the scope to a different setting previously established for that scope, firearm, range, load, etc., and still remain on target without the need for further adjustments.

The present invention broadly includes a body presenting a basal member or base, and a scope assembly receiving member. The base mounts to a firearm, while the scope assembly receiving member is designed to receive a scope assembly, this typically including the scope and its associated mounting rings or other scope carrier. The scope assembly receiving member is selectively positionable relative to the base (and thus the firearm), at a desired one of a plurality of preselected positions. The positions are preferably determined by individually and independently adjustable stops which maintain a desired relative position between the base member and the scope assembly receiving member.

In preferred embodiments, the scope receiving member is pivotally mounted relative to the base by a pivot pin. The pivot pin is configured for ease of insertion and removal without the need for tools, thus enabling the scope mount of the present invention to be modular. That is, the scope receiving member and the scope assembly mounted thereto can be removed and a new scope assembly and scope receiving member can be mounted to the base, with the firearm being immediately sighted in and ready to use.

In facilitating the modular character of the invention, the scope mount hereof, in preferred forms, includes a rotatable turret carrying a plurality of stops. Most preferably, the turret is mounted to the scope receiving member so that the turret and its preset and individually and independently adjustable stops can be adjusted for a particular scope and replaced as a unit therewith.

The construction is particularly rugged and accommodates for the recoil of the firearm by the inclusion, in preferred forms, of a means for maintaining the base and the scope assembly receiving member in their relative positions as determined by the stop. In preferred forms, this includes a screw which is threaded into at least one of the base and scope receiving member and engages the other. Additionally, a locking insert may be provided to resist rotation of the screw and thus undesired relative movement of the base and scope assembly receiving member.

These and other advantages will be readily apparent in reviewing the drawing and the description of the preferred embodiment, though the scope of the invention is intended to include other embodiments and as such should be determined by reference to the claims.

DESCRIPTION OF THE PREFERRED EMBODIMENT

Figures 1, 2, 3, 4, 5:
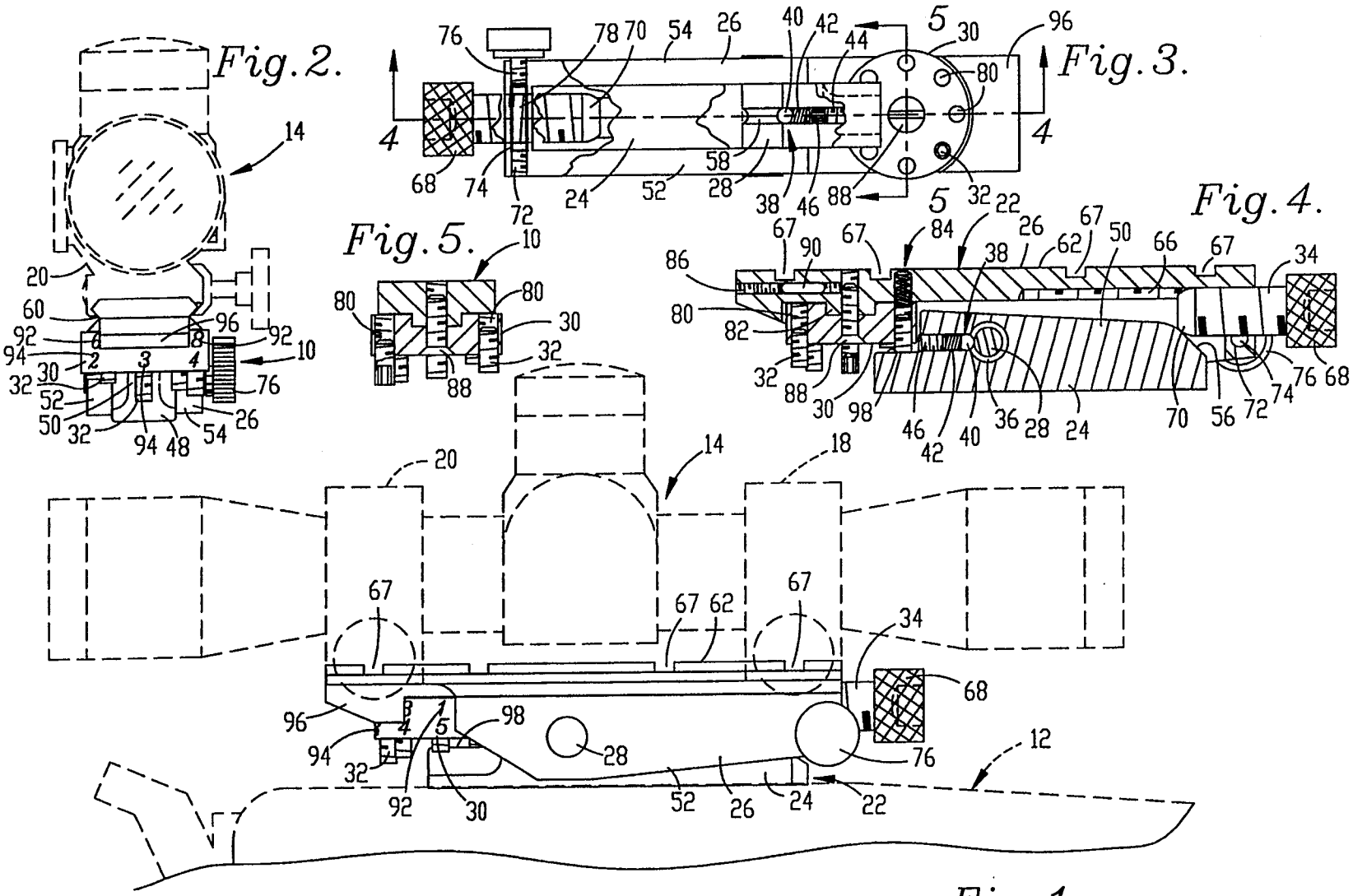
FIG. 1 is a right side elevational view of the selectively adjustable firearm scope mount hereof, showing a telescopic sight and mount rings positioned thereon, and a handgun carrying scope mount also shown in phantom.
FIG. 2 is a rear elevational view of the scope mount hereof showing the adjustment turret.
FIG. 3 is a bottom plan view of the scope mount hereof with portions of the securement screw and the grooved rib broken away to reveal the front locking insert and the removable pivot pin.
FIG. 4 is a vertical cross-sectional view of the scope mount hereof taken along line 4—4 of FIG. 3.
FIG. 5 is a vertical cross-sectional view of the turret and grooved rib of the scope mount hereof taken along line 5—5 of FIG. 3.

Referring now to the drawing, a selectively adjustable firearm scope mount 10 is shown mounted to a firearm, and more particularly a handgun 12, and carrying a scope assembly 14, each of the latter being shown in phantom. The scope mount 10 may also be used with other firearms such as rifles and shotguns for holding telescopic sight assemblies. Such scope assemblies 14 typically include a telescopic sight 16 and a pair of mounting rings 18, 20.

In greater detail, the scope mount 10 includes a body 22 including a base 24 and a rib 26 for receiving the scope assembly 14 thereon. The scope mount 10 also includes means for positioning the base 24 relative to the rib 26 which includes a pivot pin 28, a turret 30 carrying a plurality of stops 32, and holding screw 34 for maintaining the base and rib in their relative positions.

Base 24 is preferably a unitary member of stainless steel or aluminum which is mounted to the receiver of the handgun 12. The base 24 may be grooved and/or drilled and tapped at the bottom thereof according to the type and make of firearm with which it will be employed. Although the base 24 may be removed from the firearm with the use of tools, in the modular concept presented herein the base 24 would remain mounted to the handgun 12 and one of several different ribs 26 with their turrets 30; stops 32 scope assembly 14 mounted thereon would be substituted. The base 24 presents a transversely extending bore 36 for receiving pivot pin 28 therethrough. Centered laterally along the bore 36 is a self-contained ball detent assembly 38 including a ball 40, a spring 42 biasing the ball toward the pivot pin 28, and a threaded plug 46 received into a cavity 44. Such detent assemblies are available from the Carr-Lane Company.

Base 24 presents a flared bottom 48 and a central spine 50 which is located between depending shoulders 52 and 54 of rib 26. The forward surface 56 of spine 50 is tapered downwardly and forwardly as shown in FIG. 4 for engaging screw 34 as will be described hereinafter.

Pivot pin 28, while substantially cylindrical, is provided with a centrally located circumscribing channel 58 for receiving ball 40 of detent assembly 38. Pivot pin 28 pivotally connects rib 26 with base 24. Rib 26 is elongated and presents a groove 60 extending longitudinally along each side for receiving the scope rings 18 and 20 which clamp thereon, a top shelf 62, a front wall 64 which is threaded for receiving screw 34 therein, and shoulders 52 and 54 positioned relatively laterally outboard to spine 50. The forward portion of the underside 66 of rib 26 is threaded as shown in FIG. 4 to partially receive screw 34. A plurality of transversely oriented channels 67 are provided in shelf 62 for accommodating the screws associated with the clamps at rings 18 and 20.

Screw 34 is provided with a knurled head 68 extending forwardly of body 22 and a bevelled or rounded nose 70 for engaging forward surface 56 of base 24. The knurled head 68 allows easy manipulation of the screw without the use of tools, while the nose 70 gradually engages forward surface 56 without digging in or damaging the latter. The front wall 64 of rib 26 includes a transversely oriented opening 72 for receiving therein a synthetic resin insert 74 and a locking screw 76. The insert 74 is threaded along the portion 78 thereof which is in engaging relationship with the screw 34, and the opening is threaded whereby locking screw 76 can be tightened to force insert 74 into locking engagement with the threads of the screw 34 to inhibit longitudinal movement of the latter.

Turret 30 is rotatably mounted to the rib 26 at the opposite end of screw 34. Turret 30 presents a plurality of arcuately spaced cavities 80 each threadably receiving a stop 32. The rib 26 presents a neck 82 which is received within a corresponding recess in the turret 30. The turret 30 is free to rotate around the neck extending down from the rib 26, limited by the engagement of a spring-loaded catch 84 with cavities 80. When the stops 32 are in a down position, as illustrated by stop 32A in FIG. 4, its corresponding cavity 80A is open to receive catch 84 therein to resist unintended rotation of the turret 30. Advantageously, if one of the stops is not in use, it may be screwed up into its respective cavity to effectively mask the cavity, whereby the spring loaded catch will glide thereover as the turret 30 is rotated therepast. The turret 30 is coupled to the rib 26 by a set screw 88 inserted through an unthreaded central opening in the turret 30 and threaded into the neck 82. A screw 86 is inserted in a longitudinally oriented opening in the rib and threaded into engagement with a dowel 90 to force synthetic resin dowel 90 into engagement with the set screw 88 to hold the screw 88 against undesired loosening. The turret 30 is conveniently provided with a first row 92 of indicia and a second row 94 of indicia on the outside thereof corresponding to a separate stop 32. The first row 92 corresponds to the stop 32 adjacent thereto while the second row 94 corresponds to the stop 32 opposite from the indicia. An overhang 96 on the rib 26 masks the rearmost first row of indicia so only the second row is visible during shooting to avoid confusing the shooter.

In operation, the base 24 is first mounted to the receiver or other desired location on the firearm 12. The scope assembly 14 is clamped onto the groove 60 of rib 26. The rib 26 is then positioned on the base 24 and the pivot pin 28 inserted through the shoulders 52 and 54 and through bore 36 until detent assembly 38 engages the channel 58 on the pivot pin 28. The scope mount 10 is then ready for sighting in.

The shooter then fires the pistol using a first desired load in the conventional manner and notes the position of the shot on the target. He or she can then adjust the stop 32 on the turret 30 until the desired elevation is obtained at that range. The shooter notes the indicia corresponding to this first position, and then moves to a second range. The turret 30 is rotated to a second stop and the process is repeated. Each time the turret 30 is rotated and/or a stop 32 is adjusted, the screw 34 will be loosened or tightened against the front surface 56 to ensure that the stop 32 is fully seated against the anvil 98 at the rear end of the base 24. The shooter can preset and individually adjust each stop 32 corresponding to different ranges, e.g. 25 yard, 50 yards, 100 yards and 200 yards. In the embodiment shown, up to eight different ranges can be accommodated. In the alternative, the shooter may wish to have some settings for a first cartridge load and some settings for a second cartridge load (e.g. different powder amounts or bullet weights). The process of sighting in the scope is the same as for the different ranges. After completing this process, the firearm is sighted in for the desired conditions with that scope assembly.

The shooter may wish to use a different scope for the same firearm in order to present a different magnification, sight picture, etc. In this circumstance, the shooter need only remove the pivot pin 28 by pushing it out with his finger, remove the rib 26 with the scope assembly 14 mounted thereto, and substitute a new rib 26 with a new scope assembly already mounted thereto. Assuming the new rib 26 and scope assembly have been sighted in as described above, the shooter need only rotate the turret to the desired stop according to the cartridge load, range or other conditions and tighten the screw 34 against the front surface 56 and the firearm is ready and sighted in.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. An assembly for quick-detach mounting of a scope to a firearm in order to facilitate rapid changeover of scopes without the need for tools, said mounting assembly comprising:

an elongated base adapted for mounting to the firearm and including structure defining a transverse bore therein;

means for supporting the firearm scope and presenting an opening therein in registry with said transverse bore; and means for releasably coupling said scope-supporting means and said base including an elongated coupling pin presenting a longitudinal axis received within said opening and said bore, and spring-biased detent means releasably retaining the pin within the opening and said bore, said pin-retaining detent means including structure for permitting manual removal of said pin from said opening and said bore in order to allow detachment of said scope-supporting means from said base, said base and said scope-supporting means each carrying respective, interengaging components for adjustment of the elevation of the scope on the firearm by pivoting movement of said scope-supporting means about the longitudinal axis of said pin, whereby, upon detachment of said scope-supporting means from said base another scope-supporting means may be installed on said base.

2. The assembly of claim 1, said detent means including structure defining a circumscribing groove in said coupling pin, a detent ball carried by said base, and spring means for resiliently urging said ball into interengagement with said groove when said pin is received within said opening and said bore.

3. The assembly of claim 1, said base including structure defining an abutment surface, said scope-supporting means including a rotatable turret holding a plurality of spaced-apart engagement elements mounted for selective, individual adjustment of each said element respectively and relative to each other.

4. A method of substituting telescopic sights on a firearm comprising the steps of:

providing a firearm, an elongated base mounted to the firearm, a first scope assembly including a first telescopic sight and mounting rings therefore, a first scope assembly supporting means for carrying said scope assembly therewith and including adjustment means for providing a plurality of preselected elevation positions corresponding to different elevations of the first telescopic sight relative to the firearm, a second scope assembly including a second telescopic sight and mounting rings therefore, a second scope assembly supporting means for carrying said second scope assembly therewith and including adjustment means for providing a plurality of preselected elevation positions corresponding to different elevations of the second telescopic sight relative to the firearm, and means releasably coupling said first supporting means to said base;

removing said coupling means to disconnect said first supporting means from said base;

substituting said second supporting means and the second scope assembly carried thereby for said first supporting means and the first scope assembly carried thereby on said base; and replacing said coupling means to positively connect said second supporting means to said base, wherein after substitution of said second supporting means and the second scope assembly carried thereby, the firearm is sighted in at the preselected elevation positions of said second supporting means without further adjustment between the second supporting means and the second scope assembly carried thereby.

* * * * *